United States Patent [19]

Stewart et al.

[11] 4,360,882

[45] Nov. 23, 1982

[54] PROCESS CONTROL SYSTEM

[75] Inventors: William S. Stewart; Gary L. Funk, both of Bartlesville, Okla.

[73] Assignee: Phillips Petroleum Company, Bartlesville, Okla.

[21] Appl. No.: 181,912

[22] Filed: Aug. 27, 1980

[51] Int. Cl.[3] ..... G05B 15/00; F01D 17/02

[52] U.S. Cl. ..... 364/494; 364/140; 415/15

[58] Field of Search ..... 364/494, 110, 118, 104; 415/15; 60/648, 663, 600, 602

[56] References Cited

U.S. PATENT DOCUMENTS

| | | | |
|---|---|---|---|
| 2,973,772 | 3/1961 | Oglesby, Jr. | 137/82 |
| 3,515,860 | 6/1970 | Fitzgerald, Jr. | 364/118 X |
| 3,581,070 | 5/1971 | Tsujihata et al. | 364/110 X |
| 3,824,387 | 7/1974 | Garst | 340/413 X |
| 3,836,834 | 9/1974 | Abbatiello et al. | 318/563 |
| 4,042,809 | 8/1977 | Shetler | 364/110 |
| 4,053,746 | 10/1977 | Braytenbah | 364/494 |
| 4,090,065 | 5/1978 | Braytenbah | 364/110 X |
| 4,158,226 | 6/1979 | Struger et al. | 364/104 |

*Primary Examiner*—Edward J. Wise

[57] ABSTRACT

In a process in which both a turbine or motor and an expander are utilized to drive a compressor, the use of the expander is substantially maximized while still insuring that the driving force applied to the turbine or motor does not go below a low limit. A variable limit is also utilized to prevent a stuck valve from being overdriven by a controller.

13 Claims, 3 Drawing Figures

PROCESS CONTROL SYSTEM

This invention relates to process control. In one aspect this invention relates to method and apparatus for controlling a process in which a compressor is driven both by a turbine or motor and the expansion of a process gas. In another aspect this invention relates to a method and apparatus for preventing a controller from overdriving a stuck valve.

Compressors are utilized in many processes to compress a gas for use in the process. A turbine or motor is generally utilized to start up the compressors and supply at least a portion of the power required to run the compressor. However, the use of high pressure steam, combustion of a fuel or electricity to drive a turbine or motor results in high compression cost which may have an adverse affect on the economic viability of the process. This problem may be at least partially overcome if a process gas stream under pressure is available for expansion. The expansion of the process gas can be utilized to supply power to drive the compressor.

As used herein, the term "process gas" refers to any gas stream which is either used by or produced by the process. Generally, only water gas streams such as flue gases or gas streams flowing out of a reactor or other process equipment are "available for expansion". However, any process gas stream which can be reduced in pressure without adversely affecting the process may be utilized to drive the compressor if desired.

When a process gas stream is available for expansion, it is desirable to utilize the process gas stream as fully as possible. However, care must be taken to not drive the compressor exclusively with the process gas in such a manner that the driving force supplied to the turbine or motor (referred to hereinafter as a "secondary driving means") is reduced to a point where control is lost of the turbine or motor. It is thus an object of this invention to provide method and apparatus for controlling a process in which a compressor is driven both by a secondary driving means and the expansion of a process gas in such a manner that maximum utilization is made of the process gas without allowing the driving force applied to the secondary driving means to be below some low limit.

Control valves utilized in process control may remain in the same position for a long period of time. If not moved periodically the control valves may have a tendency to stick when it is desired to move the control valves. This tendency is enhanced if particles are present in a fluid flowing through the control valve.

If the control valve is under automatic control and sticks when a change in the set point is made, a dangerous situation may occur. The integral portion of the control signal will continue to increase and apply pressure to the control valve. This may create a situation in which sufficient force is placed on the control valve to cause the control valve to go completely open or completely shut when the control valve does become unstuck. It is thus another object of this invention to provide method and apparatus for preventing a controller from overdriving a stuck control valve.

In accordance with the present invention, a pneumatic control valve controlling the flow of the process gas to the expander is manipulated so as to substantially maximize the flow of the process gas to the expander while holding the bypassing of the process gas around the expander to some desired minimum level unless the driving force applied to a secondary driving means driving the compressor below a desired minimum level. If the driving force applied to a secondary driving means goes below some minimum point, then the control valve controlling the flow of process gas to the expander is manipulated so as to insure that the driving force applied to a secondary driving means does not go below the minimum point. In this manner, use of the waste gas is maximized while insuring that at least a desired minimum driving force is applied to the secondary driving means which results in improved process economics.

Method and apparatus is also provided in which a variable high or low limit is utilized to prevent a controller from overdriving a stuck control valve. Control is based on the output of the controller if the valve is not stuck. However, if the valve becomes stuck, the variable high or low limit takes effect until such time as the valve becomes unstuck. This prevents a situation from being created in which sufficient force is placed on the control valve to cause the control valve to go to a completely open or completely shut position when the control valve does not become unstuck thus avoiding a dangerous situation.

Other objects and advantages of the invention will become apparent from the foregoing brief description of the invention and the claims as well as the brief description of the drawings in which:

The invention is described in terms of the use of a compressor to supply air to a catalyst regenerated associated with a fluid catalytic cracker unit and is also described in terms of utilizing the large volume of flue gas flowing from the catalyst regenerator to drive the expander. However, the invention is applicable to any process in which a compressor may be driven both by a secondary driving means and an expander and in which it is desired to maximize the use of the expander.

The invention is also described in terms of using a steam driven turbine as the secondary driving means. However, the invention is applicable to the use of any other suitable type of driving means such as an electric motor or fuel fired turbine. Since the invention is described in terms of a steam driven turbine, the flow of steam to the turbine provides a convenient measurement of the driving force applied to the turbine. Other indications of the driving force applied could be utilized and would be utilized if another form of power is utilized to drive the turbine or a different type of secondary driving means is utilized.

The variable limit control for a stuck valve is illustrated and described in terms of a butterfly valve located in the line supplying the regenerator flue gas to the expander. This type of valve has a particular tendency to stick especially when particles are present in the gas such as would be present in the flue gas from the catalyst regenerator. However, the variable limit control for a stuck valve is applicable to any type of control valve which may have a tendency to stick.

Figure 1:
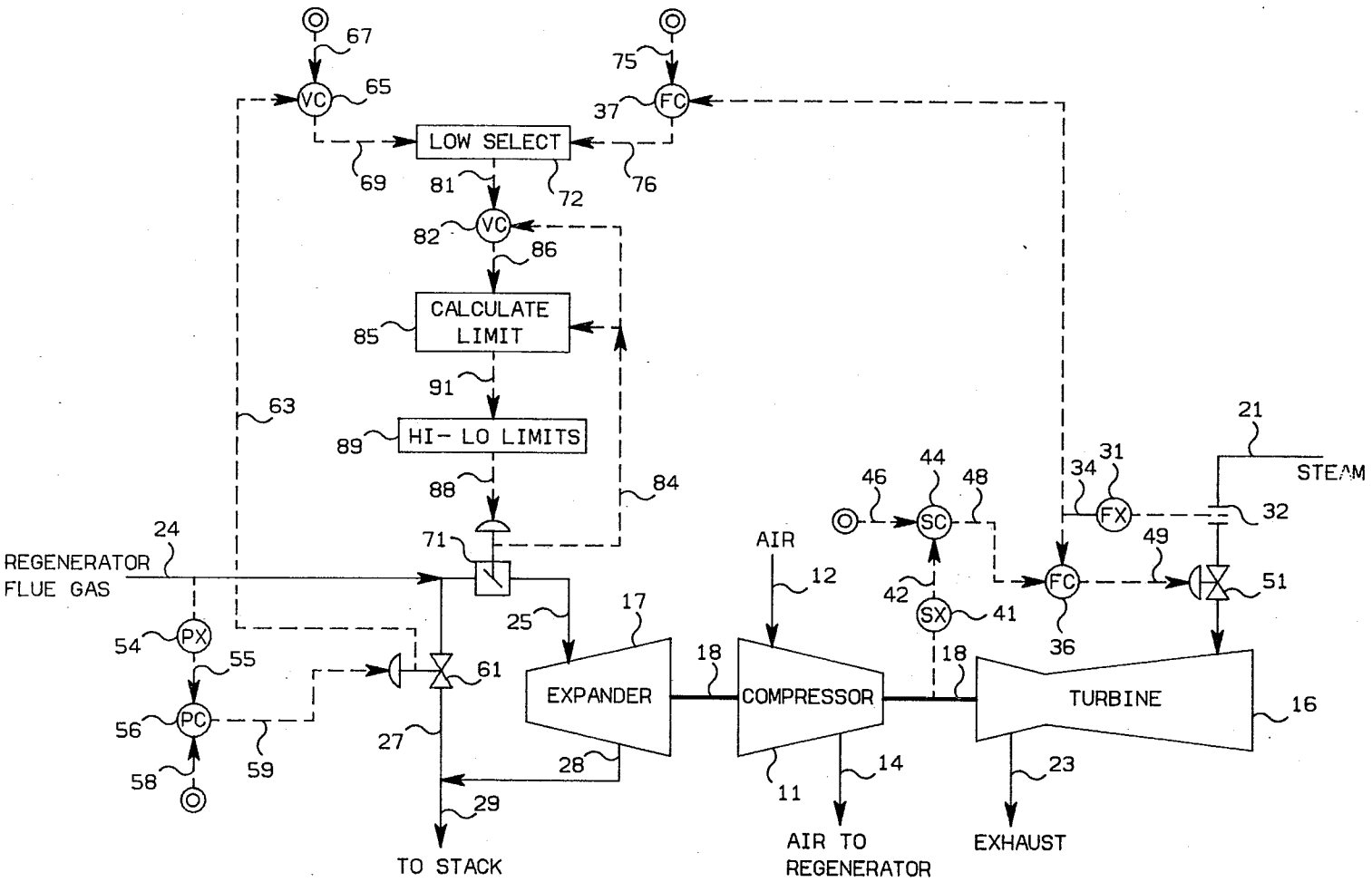
FIG. 1 is a diagrammatic representation of a compressor driven both by a turbine and an expander and an associated control system.

A specific control system configuration is set forth in FIG. 1 for the sake of illustration. However, the invention extends to different types of control system configurations which accomplish the purpose of the invention. Lines designated as signal lines in the drawings are electrical or pneumatic in this preferred embodiment. Generally, the signals provided from any transducer are electrical in form. However, the signals provided from pressure sensors or flow sensors will generally be pneumatic in form. Transducing of these signals is not illustrated for the sake of simplicity because it is well known in the art that if a flow is measured in pneumatic form it must be transduced to electrical form if it is to be transmitted in electrical form by a flow transducer. Also transducing of signals from analog form to digital form or digital form to analog form as required is not illustrated since this is also well known.

The invention is also applicable to mechanical, hydraulic or other signal means for transmitting information. In almost all control systems some combination of electrical, pneumatic, mechanical or hydraulic signals will be used. However, use of any other type of signal transmission, compatible with the process and equipment in use, is within the scope of the invention.

The controllers shown may utilize the various modes of control such as proportional, proportional-integral, proportional-derivative, or proportional-integral-derivative. In this preferred embodiment, proportional-integral-derivative controllers are utilized but any controller capable of accepting two input signals and producing a scaled output signal, representative of a comparison of the two input signals, is within the scope of the invention. The operation of proportional-integral-derivative controllers is well known in the art. The output control signal of a proportional-integral-derivative controller may be represented as $$S=K_1E+K_2\int Edt+K_3(dE)/(dt)$$

where

S=output control signals;

E=difference between two input signals; and $K_1$, $K_2$ and $K_3$=constants.

The scaling of an output signal by a controller is well known in control system art. Essentially, the output of a controller may be scaled to represent any desired factor or variable. An example of this is where a desired flow rate and an actual flow rate is compared by a controller. The output could be a signal representative of a desired change in the flow rate of some gas necessary to make the desired and actual flows equal. On the other hand, the same output-signal could be scaled to represent a percentage or could be scaled to represent a temperature change required to make the desired and actual flows equal. If the controller output can range from 0 to 10 volts, which is typical, then the output signal could be scaled so that an output signal having a voltage level of 5.0 volts corresponds to 50 percent, some specified flow rate, or some specified temperature.

The various transducing means used to measure parameters which characterize the process and the various signals generated thereby may take a variety of forms or formats. For example, the control elements of the system can be implemented using electrical analog, digital electronic, pneumatic, hydraulic, mechanical or other similar types of equipment or combinations of one or more of such equipment types. While the presently preferred embodiment of the invention preferably utilizes a combination of pneumatic final control elements in conjunction with electrical analog and digital signal handling and translation apparatus, the apparatus and method of the invention can be implemented using a variety of specific equipment available to and understood by those skilled in the process control art. Likewise, the format of the various signals can be modified substantially in order to accommodate signal format requirements of the particular installation, safety factors, the physical characteristics of the measuring or control instruments and other similar factors. For example, a raw flow measurement signal produced by a differential pressure orifice flow meter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameter. Regardless of the signal format or the exact relationship of the signal to the parameter which it represents, each signal representative of a measured process parameter or representative of a desired process value will bear a relationship to the measured parameter or desired value which permits designation of a specific measured or desired value by a specific signal value. A signal which is representative of a process measurement or desired process value is therefore one from which the information regarding the measured of desired value can be readily retrieved regardless of the exact mathematical relationship between the signal units and the measured or desired process units.

Referring now to the drawings and in particular to FIG. 1, there is illustrated a compressor 11. Air is supplied to the suction inlet of the compressor through conduit means 12. Air is supplied from the discharge outlet of the compressor 11 to a catalyst regenerator (not illustrated) associated with a fluid catalytic cracker unit (not illustrated) through conduit means 14. The compressor 11 is driven by both the turbine 16 and the expander 17 by means of the shaft 18 which is integral between the expander and turbine. Steam is supplied to the turbine 16 through conduit means 21 and is exhausted through conduit means 23.

Flue gas flowing from the catalyst regenerator is supplied to the expander 17 through the combination of conduit means 24 and 25. The flue gas flowing from the regenerator will typically be at a temperature of about 1100° F. and at a pressure of about 18 to about 20 psig. A very large volume on the order of 100,000 standard cubic feet per hour of flue gas is generally provided from a catalyst regenerator. A portion of the flue gas flowing through conduit means 24 may be bypassed around the expander 17 through conduit means 27. Gas is withdrawn from the expander 17 through conduit means 28. The combination of the gas flowing through conduit means 27 and the gas flowing through conduit means 28 is provided to a stack through conduit means 29.

The flow transducer 31 in combination with the flow sensor 32 provides an output signal 34 which is representative of the flow rate of the steam flowing through conduit means 21. Signal 34 is provided as an input to both the flow controller 36 and the flow controller 37.

The speed transducer 41 in combination with a RPM measuring device associated with the shaft 18 provides an output signal 42 which is representative of the speed of the shaft 18. Signal 42 is provided from the speed transducer 41 as an input to the speed controller 44. The speed controller 44 is also provided with a set point signal 46 which is representative of the desired speed of the shaft 18. In response to signals 42 and 46 the speed controller 44 establishes an output signal 48 which is responsive to the difference between signals 42 and 46. Signals 48 is scaled so as to be representative of the flow rate of the steam flowing through conduit means 21 required to maintain the speed of the shaft 18 equal to a desired speed. Signal 48 is provided from the speed controller 48 to the flow controller 36.

In response to signals 34 and 48 the flow controller 36 establishes an output signal 49 which is responsive to the difference between signals 34 and 48. Signal 49, which is scaled so as to be representative of the position of the pneumatic control valve 51 required to maintain the actual flow rate of the steam substantially equal to the desired flow rate of the steam, is provided from the flow controller 36 to the pneumatic control valve 51 which is operably located in conduit means 21. The pneumatic control valve 51 is manipulated in response to signal 49 to thereby maintain the actual speed of the shaft 18 as represented by signal 42 substantially equal to the set point speed for the shaft 18 as is represented by signal 46.

The pressure transducer 54 in combination with a pressure sensing device operably located in conduit means 24 provides an output signal 55 which is representative of the pressure of the flue gas flowing through conduit means 24. Signal 55 is provided from the pressure transducer 54 to the pressure controller 56. The pressure controller 56 is also provided with a set point signal 58 which is representative of the desired pressure of the flue gas flowing through conduit means 24.

In response to signals 55 and 58 the pressure controller 56 establishes an output signal 59 which is responsive to the difference between signals 55 and 58. Signal 59 is provided from the pressure controller 56 to the pneumatic control valve 61 which is operably located in conduit means 27. Signal 59 is scaled so as to be representative of the position of the pneumatic control valve 61 required to maintain the actual pressure of the flue gas flowing through conduit means 24 substantially equal to the desired pressure as represented by signal 58. The pneumatic control valve 61 is manipulated in response to signal 59.

Signal 63, which is representative of the position of the pneumatic control valve 61, is provided as an input to the valve controller 65. Signal 63 will be effectively representative of the actual percent opening of the pneumatic control valve 61. The valve controller 65 is also provided with a set point signal 67 which is representative of the desired percent opening of the pneumatic control valve 61. The set point signal 67 is chosen so as to insure that the pneumatic control valve 61 is maintained in a control range. A preferred value for set point signal 67 is about 10 percent open. If the pneumatic control valve 61 is much less than 10 percent opened, the response to the pneumatic control valve becomes non-linear and it is very difficult to further reduce the percent opening of the pneumatic control valve 61 if such reduction is needed.

In response to signals 63 and 67, the valve controller 65 establishes an output signal 69 which is responsive to the difference between signal 63 and 67. Signal 69 is scaled so as to be representative of the position of the butterfly valve 71 required to insure that the percent opening of the pneumatic control valve 61 does not go below the percent opening represented by the set point signal 67. Signal 69 is provided from the valve controller 65 to the low select 72.

The flow controller 37 is also provided with a set point signal 75 which is representative of the minimum flow rate for the steam flowing through conduit means 21. In response to signals 34 and 75, the flow controller 37 establishes an output signal 76 which is responsive to the difference between signals 34 and 75. Signal 76 is scaled so as to be representative of the position of the butterfly valve 71 which is required to insure that the flow rate of the steam flowing through conduit means 21 does not go below the low flow steam set point represented by signal 75. Signal 76 is provided from the flow controller 37 as an input to the low select 72.

Both signals 69 and 76 are representative of a desired valve position for the butterfly valve 71. Signal 69 may require the butterfly valve 71 to be 80 percent open while the signal 76 would require the butterfly valve to be 90 percent open. Whichever of signals 69 and 76 is representative of the lower percentage is the signal which will be provided from the low select 72 as signal 81 to the valve controller 82. Thus, the butterfly valve 71 will be manipulated so as to insure that only a desired minimum of gas is being bypassed around the expander 17 unless the flow rate of the steam flowing through conduit means 21 begins to go below the set point signal represented by signal 75. If this condition occurs, then the position of the butterfly valve 71 will be manipulted so as to cut back on the flow of flue gas to the expander and bypass more gas through conduit means 27 so as to require more steam to be supplied to the turbine 16 to maintain the speed of the shaft 18 substantially equal to the desired speed of the shaft represented by the set point signal 46. In this manner, use of the flue gas flowing through conduit means 24 to drive the compressor 11 is substantially maximized while insuring that the flow of steam to the turbine 16 does not go below a required minimum flow rate.

Signal 84, which is representative of the actual percent opening of the butterfly valve 71, is provided as an input to both the calculate limit block 85 and the valve controller 82. In response to signals 81 and 84, the valve controller 82 establishes an output signal 86 which is responsive to the difference between signals 81 and 84. If the butterfly valve 71 is not stuck and a fixed high or low limit is not exceeded by signal 86 then signal 86 is effectively provided as signal 88 to the butterfly valve 71 and the butterfly valve 71 is manipulated in response to signal 88 which is equal to signal 86. If a fixed high or low limit for the butterfly valve 71 is exceeded by signal 86 then signal 88 will be representative to that high or low limit and the butterfly valve 71 will be manipulated in response to the high or low limit. The high and low limits of block 89 are provided as safety features.

If the butterfly valve 71 is stuck, then the calculate limit block 85 comes into effect. If the butterfly valve 71 is stuck, signal 84 will not change in response to a change in signal 81. This will cause the integral term of the output from the valve controller 81 to continue to increase and signal 86 may assume a very high or low value. As has been previously stated, this can result in a very dangerous situation.

As an example, consider a situation in which the desired valve position represented by signal 86 is 95 percent open and the actual valve position of the butterfly valve 71 is 95 percent open. Assume that a change in set point causes the desired valve position signal 81 to go to 90 percent open. However, if the valve 71 is stuck, signal 84 will remain at 95 percent open. This will cause signal 86 to continue to decrease to try to force the actual valve position to equal the desired valve position. The hard low limit may be set at 10 percent open. Thus, signal 86 may decrease to a point where the butterfly valve 71 will go to 10 percent open when it does become unstuck rather than the 90 percent open which is desired. This rapid closing of the butterfly valve 71 is dangerous and should be avoided if at all possible.

In accordance with the present invention the dangerous situation caused by a stuck valve is prevented by utilizing a variable or calculated limit. Effectively, signal 91 from the calculate limit block 85 will be equal to signal 86 if the butterfly valve 71 is not stuck. However, if the butterfly valve is stuck, signal 91 will assume a value which is equal to the valve position of the butterfly valve 71 plus some constant K when the absolute value of the actual valve position represented by signal 84 subtracted from the value of signal 86 is greater than the same constant K. If the output signal 86 from the valve controller 82 is represented as P, the output signal 91 from the calculate limit block 85 is represented as L, and signal 84 is represented as V then the function of the calculate limit block may be represented as $$L = \begin{cases} V + K \text{ when } |P - V| > K \\ P \text{ elsewhere} \end{cases}$$

Signal 86 should be scaled in such a manner that the magnitude of signal 86 is equal to the magnitude of signal 84 when the actual position of the butterfly valve 71 is equal to the desired position represented by signal 81. When signal 81 changes and signal 84 does not change signal 86 will begin to increase or decrease until the absolute value of P-V is greater than K which typically is in the range of about 10 percent to about 20 percent of the fixed high limit value. When the butterfly valve 71 becomes unstuck, signal 86 will begin to return to the value of signal 84 until such time as the absolute value of P-V is not greater than K and then control will be returned to signal 86 directly. Thus, a variable limit of the actual valve position plus some constant K is utilized to prevent a stuck valve from being driven to the fixed high or low limits when the valve becomes unstuck.

Figure 2:
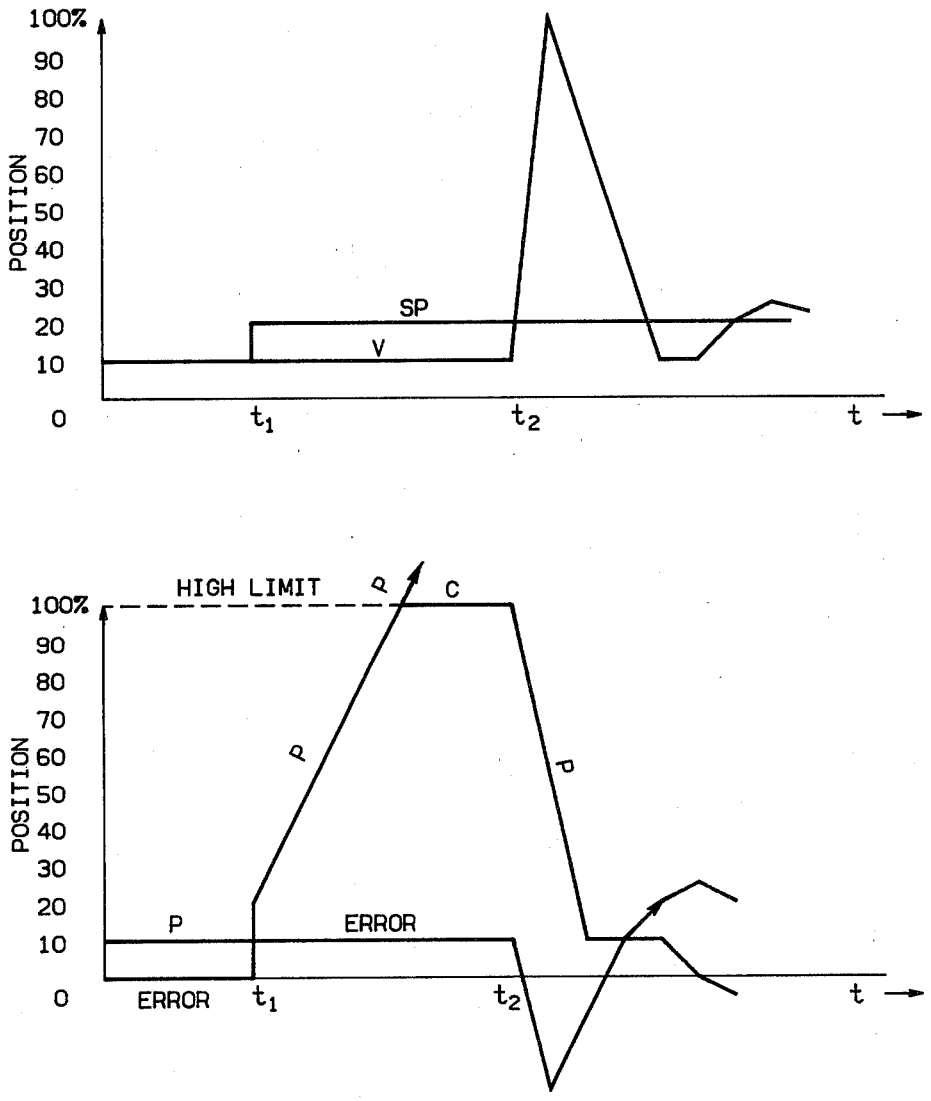
FIG. 2 is an illustration of what can occur when a control valve sticks if the controller is not prevented from overdriving the stuck control valve.
Figure 3:
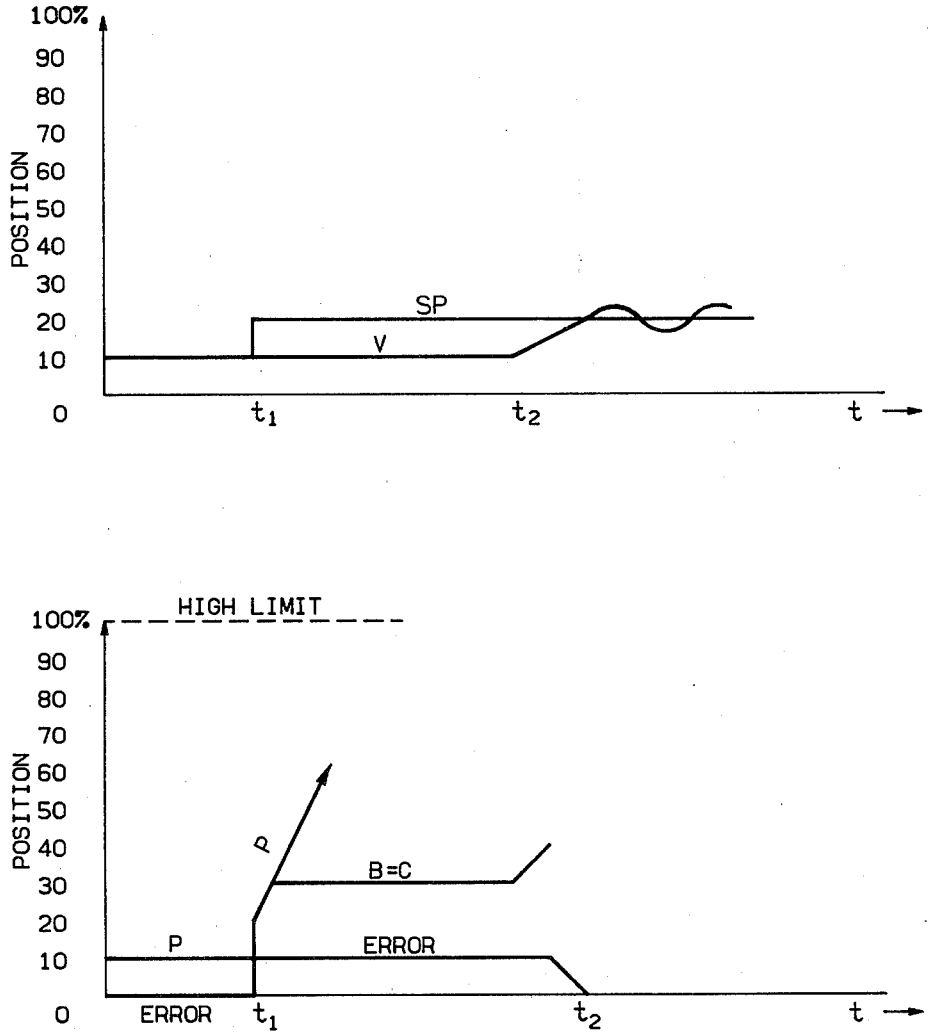
FIG. 3 is an illustration of the effects of using a variable limit in accordance with the present invention.

FIGS. 2 and 3 will be utilized to illustrate the affect of the calculate limit block 85. FIG. 2 illustrates a plot of the valve travel (V), set point (SP), controller output (P), and error (E) as a function of time. Assuming that the valve is stuck, at a time $t_1$, when a change in set point is made, the valve position V will remain constant and the error which has been zero will go to 10 percent. The output of the controller P will start to increase until a high limit, which has been chosen as 100 percent open, is reached. P will continue to increase but the actual signal being applied to the valve will remain at 100 percent fully open. At a time $t_2$ the valve becomes unstuck. The valve will be forced fully open which will cause a dramatic change in the error signal. The change in the error will cause the output of the controller P to decrease and the output will again take control causing the valve to return towards the set point position and oscillate about that position until it finally smooths out at the set point. However, FIG. 2 illustrates that the stuck valve has caused a dangerous condition to occur in which the stuck valve is forced to a fully open position when the valve becomes unstuck.

FIG. 3 illustrated the effect of the stuck valve control of the present invention. At a time $t_1$ the set point is changed and again at a time $t_2$ the valve becomes unstuck. However, the control signal applied to the control valve is not allowed to increase to the high limit but is rather limited by the variable limit and the control signal applied to the valve takes the form of B (signal 91) illustrated in FIG. 3 which is equal to C (signal 88) because the high limit has not been reached. When the valve becomes unstuck the valve moves to the set point signal and oscillates slightly but does not open completely as is illustrated in FIG. 2.

The invention has been described in terms of a preferred embodiment as is illustrated in FIG. 1. Preferably, at least part of the control components illustrated in FIG. 1 are analog control components while the remainder are implemented on a digital computer. Preferably, the valve controller 65, the flow controller 37, the low select 72, the valve controller 82, the calculate limit block 85 and the high-low limit block 89 are implemented on a digital computer which is preferably the OPTROL 7000 Process Computer System manufactured by Applied Automation, Inc., Bartlesville, Oklahoma. Other specific components such as the butterfly valve 71, the pneumatic control valves 61 and 51, flow sensor 32, flow transducer 31; flow controller 36; feed transducer 41; speed controller 44; pressure controller 56 and pressure transducer 54 are each well known, commercially available control components such as are described at length in Perry's Chemical Engineer's Handbook, 4th Edition, Chapter 22, McGraw-Hill.

For reasons of brevity and clarity, conventional auxillary equipment which would be associated with the compressor 11, expander 17 and turbine 16 as well as the catalyst regenerator have not been illustrated or described in the above description as they play no part in the explanation of the invention.

While the invention has been described in terms of the presently preferred embodiment, reasonable variations and modifications are possible, by those skilled in the art, within the scope of the described invention and the appended claims. For example, if the stocking of a valve were not contemplated then the control system could be operated without the calculate limit 85. Further, the stuck valve control of the present invention could be utilized in any process in which sticking of a valve may be a problem.

That which is claimed is:

1. Apparatus comprising:

compressor means;

an expander means;

a secondary driving means;

a shaft connecting said expander means, said secondary driving means and said compressor means;

means for supplying a gas to the suction inlet of said compressor means;

means for supplying compressed gas from the discharge outlet of said compressor means;

means for supplying a driving force to said secondary driving means;

means for supplying a process gas to said expander means;

means for bypassing at least a part of said process gas around said expander means;

first control valve means for manipulating the flow of said process gas to said expander means;

second control valve means for manipulating the bypassing of at least a part of said process gas around said expander means;

means for establishing a first signal representative of the actual driving force being applied to said secondary driving means;

means for establishing a second signal representative of a low limit on the driving force being applied to said secondary driving means;

means for comparing said first signal and said second signal and for establishing a third signal responsive to the difference between said first signal and said second signal;

means for establishing a fourth signal representative of the actual position of said second control valve means;

means for establishing a fifth signal representative of a low limit on the position of said second control valve means;

means for comparing said fourth signal and said fifth signal and for establishing a sixth signal responsive to the difference between said fourth signal and said fifth signal;

means for comparing said third signal and said sixth signal and for establishing a seventh signal representative of the lower one of said third and sixth signals;

means for establishing an eighth signal representative of the actual position of said first control valve means;

means for comparing said seventh signal and said eighth signal and for establishing a ninth signal responsive to the difference between said seventh signal and said eighth signal; and means for manipulating said first control valve means in response to said ninth signal.

2. Apparatus in accordance with claim 1 additionally comprising:

means for determining the absolute value of the difference between said seventh signal and said eighth signal;

means for establishing a tenth signal representative of the magnitude of said eight signal plus a constant K, wherein said first control valve means is manipulated in response to said ninth signal if the absolute value of the difference between said seventh signal and said eighth signal is less than or equal to said constant K and wherein said first control valve means is manipulated in response to said tenth signal when the absolute value of the difference between said seventh signal and said eighth signal is greater than said constant K.

3. Apparatus in accordance with claim 1 wherein said secondary driving means is a steam driven turbine means, said first signal is representative of the actual flow rate of steam to said turbine means, and said second signal is representative of a low limit on the flow rate of steam to said turbine means.

4. Apparatus in accordance with claim 3 additionally comprising:

means for establishing a tenth signal representative of the speed of said shift;

means for establishing an eleventh signal representative of the desired speed of said shaft;

means for comparing said tenth signal and said eleventh signal and for establishing a twelfth signal responsive to the difference between said tenth signal and said eleventh signal, wherein said twelfth signal is scaled so as to be representative of the flow rate of the steam flowing to said turbine means required to maintain the actual speed of said shaft substantially equal to the desired speed of said shaft;

means for comparing said first signal and said twelfth signal and for establishing a thirteenth signal responsive to the difference between said first signal and said twelfth signal; and means for manipulating the flow of said steam to said turbine means in response to said thirteenth signal.

5. Apparatus in accordance with claim 4 additionally comprising:

means for establishing a fourteenth signal representative of the pressure of said process gas flowing to said expander means;

means for establishing a fifteenth signal representative of the desired pressure of said process gas;

means for comparing said fourteenth signal and said fifteenth signal and for establishing a sixteenth signal responsive to the difference between said fourteenth signal and said fifteenth signal, wherein said sixteenth signal is scaled so as to be representative of the position of said second control valve means required to maintain the actual pressure of said process gas flowing to said expander means substantially equal to the desired pressure of said process gas; and means for manipulating said second control valve means in response to said sixteenth signal.

6. Apparatus in accordance with claim 1 wherein the compressed air from said compressor means is supplied to a catalyst regenerator and said process gas is the flue gas from said catalyst regenerator.

7. Apparatus comprising:

a control valve means for manipulating the flow of a fluid;

means for establishing a first signal representative of the desired position of said control valve means;

means for establishing a second signal representative of the actual position of said control valve means;

means for comparing said first signal and said second signal and for establishing a third signal responsive to the difference between said first signal and said second signal;

means for establishing a fourth signal representative of the magnitude of said second signal plus a constant K;

means for determining the absolute value of the difference between said third signal and said second signal; and means for supplying a control signal to said control valve means to thereby manipulate said control valve means, wherein said third signal is supplied as said control signal to said control valve means if the absolute value of the difference between said third signal and said second signal is less than or equal to said constant K and wherein said fourth signal is supplied as said control signal to said control valve means if the absolute value of the difference between said third signal and said second signal is greater than said constant K.

8. A method for controlling the position of a first control valve means which is utilized to manipulate the flow of a process gas to an expander means, wherein said expander means and a secondary driving means are utilized to drive a compressor means by means of a common shaft and wherein a portion of said process gas is continuously bypassed around said expander through a second control valve means, said method comprising the steps of:

establishing a first signal representative of the driving force being applied to said secondary driving means;

establishing a second signal representative of a low limit on the driving force being applied to said secondary driving means;

comparing said first signal and said second signal and establishing a third signal responsive to the difference between said first signal and said second signal;

establishing a fourth signal representative of the actual position of said second control valve means;

establishing a fifth signal representative of a low limit on the position of said second control valve means;

comparing said fourth signal and said fifth signal and establishing a sixth signal responsive to the difference between said fourth signal and said fifth signal;

comparing said third signal and said sixth signal and for establishing a seventh signal representative of the lower one of said third and sixth signals;

establishing an eighth signal representative of the actual position of said first control valve means;

comparing said seventh signal and said eighth signal and for establishing a ninth signal responsive to the difference between said seventh signal and said eighth signal; and manipulating said first control valve means in response to said ninth signal.

9. A method in accordance with claim 8 additionally comprising the steps of:

determining the absolute value of the difference between said seventh signal and said eighth signal;

establishing a tenth signal representative of the magnitude of said eighth signal plus a constant K;

manipulating said first control valve means in response to said ninth signal if the absolute value of the difference between said seventh signal and said eighth signal is less than or equal to said constant K; and manipulating said first control valve means in response to said tenth signal when the absolute value of the difference between said seventh signal and said eighth signal is greater than said constant K.

10. A method in accordance with claim 8 wherein said secondary driving means is a steam driven turbine means, said first signal is representative of the actual flow rate of steam to said turbine means, and said second signal is representative of a low limit on the flow rate of steam to said turbine means.

11. A method in accordance with claim 10 additionally comprising the steps of:

establishing a tenth signal representative of the speed of said shaft;

establishing an eleventh signal representative of the desired speed of said shaft;

comparing said tenth signal and said eleventh signal and establishing a twelfth signal responsive to the difference between said tenth signal and said eleventh signal, wherein said twelfth signal is scaled so as to be representative of the flow rate of the steam flowing to said turbine means required to maintain the actual speed of said shaft substantially equal to the desired speed of said shaft;

comparing said first signal and said twelfth signal and establishing a thirteenth signal responsive to the difference between said first signal and said twelfth signal; and manipulating the flow of said steam to said turbine means in response to said thirteenth signal.

12. A method in accordance with claim 11 additionally comprising the steps of:

establishing a fourteenth signal representative of the pressure of said process gas flowing to said expander means;

establishing a fifteenth signal representative of the desired pressure of said process gas;

comparing said fourteenth signal and said fifteenth signal and establishing a sixteenth signal responsive to the difference between said fourteenth signal and said fifteenth signal, wherein said sixteenth signal is scaled so as to be representative of the position of said second control valve means required to maintain the actual pressure of said process gas flowing to said expander means substantially equal to the desired pressure of said process gas; and manipulating said second control valve means in response to said sixteenth signal.

13. A method for preventing a control valve means from being overdriven when said control valve means is struck comprising the steps of:

establishing a first signal representative of the desired position of said control valve means;

establishing a second signal representative of the actual position of said control valve means;

comparing said first signal and said second signal and establishing a third signal responsive to the difference between said first signal and said second signal;

establishing a fourth signal representative of the magnitude of said second signal plus a constant K;

determining the absolute value of the difference between said third signal and said second signal;

manipulating said control valve means in response to said third signal if the absolute value of the difference between said third signal and said second signal is less than or equal to said constant K which indicates that said control valve means is not stuck; and manipulating said control valve in response to said fourth signal means if the absolute value of the difference between said third signal and said second signal is greater than said constant K which indicates that said control valve means is stuck.

* * * * *